US006449457B2

(12) United States Patent
Samei et al.

(10) Patent No.: US 6,449,457 B2
(45) Date of Patent: Sep. 10, 2002

(54) TONER IMAGE FORMING DEVICE WITH BELT HEATED BY ELECTROMAGNETIC INDUCTION HEATING

(75) Inventors: Masahiro Samei; Kazunori Matsuo; Tomoyuki Noguchi; Yukinori Hara, all of Fukuoka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/741,163

(22) Filed: Dec. 21, 2000

(30) Foreign Application Priority Data

Dec. 22, 1999 (JP) ..... 11-364655

(51) Int. Cl.[7] ..... G03G 15/20
(52) U.S. Cl. ..... 399/328; 399/329
(58) Field of Search ..... 399/329, 328; 219/216

(56) References Cited

U.S. PATENT DOCUMENTS

| | | | |
|---|---|---|---|
| 5,752,148 A | 5/1998 | Yoneda et al. | |
| 5,822,669 A | 10/1998 | Okabayashi et al. | |

FOREIGN PATENT DOCUMENTS

| | | | |
|---|---|---|---|
| EP | 0 181 723 | 10/1985 | |
| JP | 1-302370 | * | 5/1988 |
| JP | 63-313182 | | 12/1988 |
| JP | 1-263679 | | 10/1989 |
| JP | 8-22206 | | 1/1996 |
| JP | 2000250338 | * | 9/2000 |
| JP | 2001060049 | * | 3/2001 |
| JP | 2001092282 | * | 4/2001 |
| JP | 2001117401 | * | 4/2001 |
| JP | 2001125407 | * | 5/2001 |
| WO | 00/52534 | | 9/2000 |

* cited by examiner

*Primary Examiner*—Quana M. Grainger
(74) *Attorney, Agent, or Firm*—Wenderoth, Lind & Ponack, L.L.P.

(57) ABSTRACT

The fixing device includes a heating roller made of magnetic metal and heated by electromagnetic induction; a fixing roller disposed parallel to the heating roller; an endless toner heating medium belt bridged across the heating roller and the fixing roller, and a press roller pressed to the fixing roller via the toner heating medium. The press roller rotates in the same direction as the toner heating medium belt to form a fixing nip region, and the belt is heated by the heating roller and rotated by the two rollers. The construction of the present invention achieves stable temperature control of the toner heating medium, and provides a stable fixing quality of the toner image.

36 Claims, 5 Drawing Sheets

TONER IMAGE FORMING DEVICE WITH BELT HEATED BY ELECTROMAGNETIC INDUCTION HEATING

FIELD OF THE INVENTION

The present invention relates to a fixing device used for image forming devices based on electrostatic-recording or electro-photographic recording such as copying machines, facsimiles and printers. The present invention further relates to a toner image fixing device using the electromagnetic induction heating method.

BACKGROUND OF THE INVENTION

Demands for faster and more energy-efficient image forming devices such as printers, copying machines and facsimiles have been increasing in the market. To satisfy such demands, it is critical to improve the thermal efficiency of fixing devices used in the image forming devices.

During image forming processes such as electro-photographic recording, electrostatic recording and magnetic recording, an image forming device forms an unfixed toner image on recording media such as recording sheets, sensitized paper and electrostatic recording paper by an image transfer method or a direct method. The unfixed toner image is fixed, in general, by a fixing device based on contact heating methods such as a hot roller method, a film heating method, or an electromagnetic induction heating method.

The fixing device of the hot roller method comprises, as a basic construction, a pair of rollers including a temperature regulated fixing roller having a heat source such as a halogen lamp and a press roller pressing against the fixing roller. A recording medium is inserted into and carried through a section where the fixing roller and press roller come into contact, a so-called fixing nip region, so that the unfixed toner image is melted and fixed by heat and pressure applied by the rollers.

The fixing device of the film heating method is disclosed, for example, in the Japanese Patent Laid-Open Publications S63-313182 and H01-263679.

In the case of the foregoing fixing device, a recording medium is positioned into a close contact with a heater which is tightly fixed to a supporting member via a thin heat-resistant fixing film. The fixing film is slid against the heating body and the heat is transferred from the heating body to the recording medium via the film. The heater in the fixing device is a ceramic heater constructed such that a resistor layer is disposed on a heat-resistant substrate having insulation property and high heat conductivity such as alumina ($Al_2O_3$) or aluminum nitride (AlN). Since this fixing device uses the thin fixing film with a low heat capacity, its heat conductivity is higher than that of the fixing device using heated rollers. Thus this fixing device achieves a shorter warm-up time, a quick-start and improved energy efficiency.

The Japanese Patent Laid-Open Publication H08-22206 discloses a fixing device based on the electromagnetic induction heating method. According to the method, a Joule heat produced by an eddy current generated in a magnetic metal member by an alternating field, heats up a heater including the metal members by an electromagnetic induction.

The following is a description of the construction of the fixing device based on the electromagnetic induction heating.

FIG. 5 is a schematic view showing a conventional fixing device of the electromagnetic induction heating. As FIG. 5 shows, the conventional fixing device comprises a guide 21, a heater 20, a film 17, and a press roller 22. The guide 21 is disposed in the inner surface of the film 17, and the heater 20 is disposed in the guide 21. The heater includes a coil unit 18 and a magnetic metal member 19. The heat-resistant, cylindrical film 17 surrounds the guide 21 such that the magnetic metal member 19 is in contact with its inner surface. The press roller 22 forms a fixing nip region N with the film 17 by pressing against the film 17 at the location where the magnetic metal member 19 is disposed, and turns the film 17.

The film 17 is made with either:

a) a single-layer film made of PTFE, PFA or FEP; or b) a composite layer film wherein the external surface of a film made of polyimides, polyamide-imides, PEEK, PES or PPS is coated with PTFE, PFA or FEP. The thickness of the film is not more than 100 $\mu$m and, preferably, between 20 $\mu$m and 50 $\mu$m.

The guide 21 is composed of a material such as PEEK and PPS with rigidity and heat-resistant properties. The heater 20 is imbedded in approximately the center of the longitudinal direction of the guide 21.

The press roller 22 comprises a core 22*a* and a surrounding heat-resistant rubber layer 22*b* composed of a material such as silicon rubber that has a high releasing ability. The press roller 22 is disposed such that it presses against the magnetic metal member 19 of the heater 20, via the film 17, at a predetermined pressure through the use of bearings or other supplemental pressuring members (not illustrated). The press roller 22 rotates counterclockwise by a driving means.

The rotation of the press roller 22 causes a friction between the press roller 22 and the film 17 and it applies a rotation power onto the film 17. The film 17 slides and turns while being fixed tightly to the magnetic metal member 19 of the heater 20.

When the heater 20 reaches a predetermined temperature, a recording medium 11 having an unfixed toner image T formed at an image forming section (not illustrated) is inserted between the film 17 and the press roller 22 at the fixing nip region N. The recording medium 11 is sandwiched between the press roller 22 and the film 17, and travels through the fixing nip region N. While the recording medium 11 is traveling through the fixing nip region N, heat from the magnetic metal member 19 is applied, via the film 17, to the recording medium 11, and its unfixed toner image T is melted and fixed. At the exit of the fixing nip region N, the recording medium 11 is separated from the surface of the film 17 and brought onto a paper tray (not illustrated).

In the fixing device based on the electromagnetic induction heating method, magnetic metal member 19, an induction heating means, can be located close to the toner image T formed on the recording medium 11 via the film 17. Therefore, compared with the fixing device using the film heating method, it enjoys higher heating efficiency.

Fixing devices for the full-color image forming devices need to be able to heat and melt over four layers of toner particles. To achieve this, a fixing device of the electromagnetic induction heating method needs to employ a resilient rubber layer of 200 $\mu$m in thickness on the surface of the film so that the toner image is adequately enclosed and evenly heated and melted.

However, if the film is coated with a 200 $\mu$m resilient layer such as silicon rubber, the heat response lowers due to the low heat conductivity of the resilient layer. As a consequence, the difference in temperature between the inner surface of the film which is heated by the heater and the outer surface which is in contact with the toner becomes significant.

Therefore, it becomes difficult to control the temperature of the surface of the film which acts as a heating medium for the toner and has a significant influence on the fixing condition of the toner.

The present invention aims at providing a fixing device based on the electromagnetic induction heating method, which controls the temperature of the toner heating medium in a stable manner.

SUMMARY OF THE INVENTION

The fixing device of the present invention comprises a heating roller, a fixing roller, an endless belt toner, and a press roller. The heating roller is made of magnetic metal and is heated by electromagnetic induction heating and the fixing roller is disposed parallel to the heating roller. The endless toner heating medium belt is bridged across the heating roller and the fixing roller, and the belt is heated by the heating roller and rotated by the two rollers. The press roller is pressed to the fixing roller via the toner heating medium belt, and the press roller rotates in the same direction as the toner heating medium to form a fixing nip region.

According to the present invention, since magnetic metal is used for the base material of the toner heating medium belt, the toner heating medium belt is heated more efficiently by induction heating.

According to the construction of the present invention, the toner heating medium belt is sent to the fixing nip region while very small temperature differences are maintained between the inner and outer surfaces of the toner heating medium belt. Therefore, the temperature of the toner heating medium belt can be strictly controlled, so that toner images can be fixed in a stable manner.

DESCRIPTION OF THE PREFERRED EMBODIMENTS

The preferred embodiments of the present invention are described with reference to FIGS. 1–4. The elements commonly shown in FIGS. 1–4 are denoted with the same numerals, and redundant description is omitted.

Figure 1:
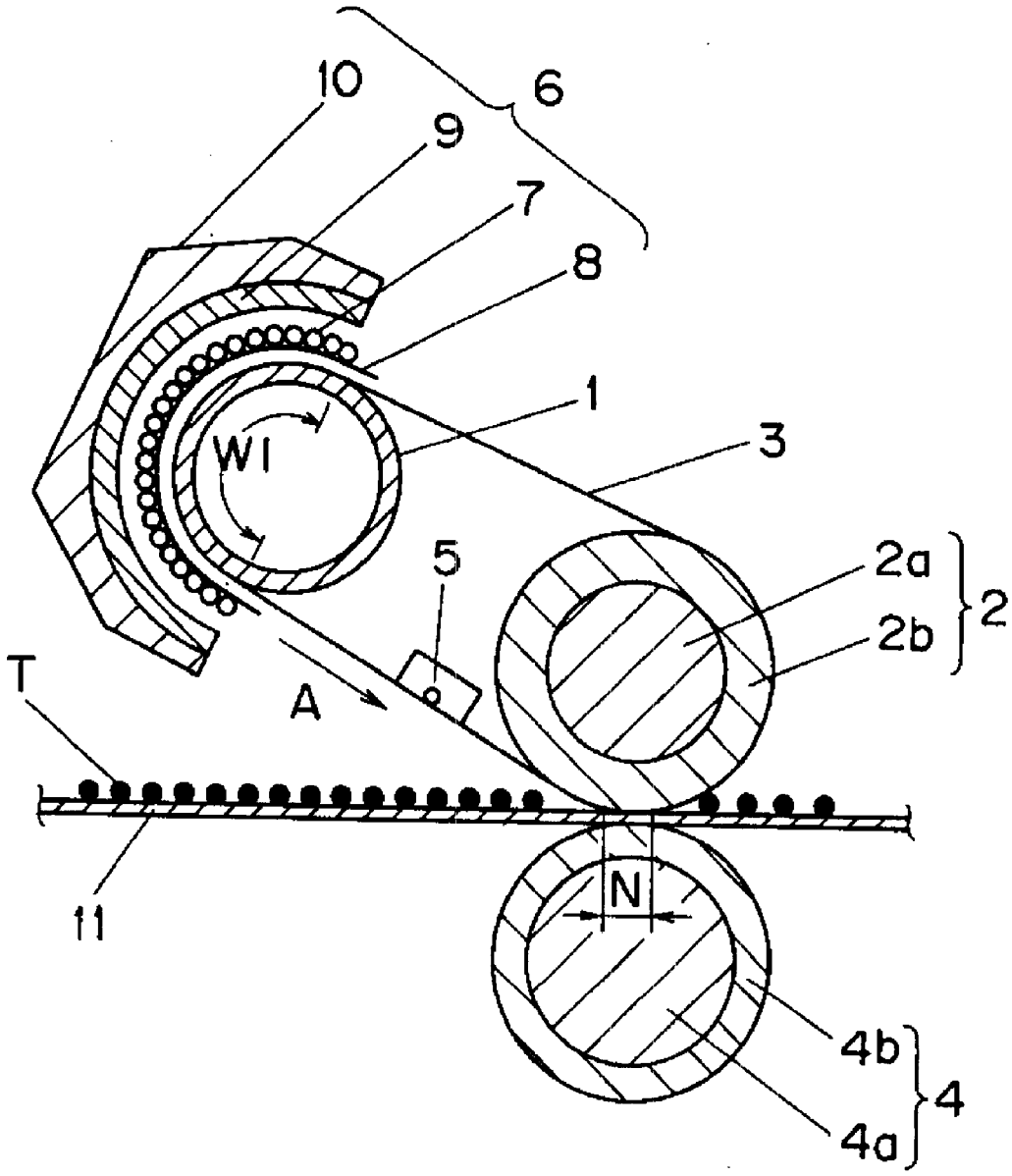
FIG. 1 shows a fixing device of a preferred embodiment of the present invention.

The fixing device in FIG. 1 comprises a heating roller 1 heated by electromagnetic induction of an induction heating means 6, a fixing roller 2 disposed parallel to the heating roller 1, a heat-resistant endless belt (toner heating medium belt) 3 bridged around the heating roller 1 and the fixing roller 2 so as to bridge across the heating roller 1 and the fixing roller 2, wherein the belt 3 is heated by the heating roller 1 and rotated by the rotation of one of the rollers in the direction shown by an arrow A; and a press roller 4 which is pressed to the fixing roller 2 via the belt 3. The roller 4 rotates in the same direction as the belt 3 (i.e., they both move in the direction of recording medium 11).

The heating roller 1 is made of a hollow cylindrical magnetic metal such as iron, cobalt or nickel, and alloys of those metals. In this embodiment, the external diameter of the heating roller 1 is 20 mm and the thickness is 0.3 mm, for example, and its temperature rises rapidly due to its low heat capacity.

The fixing roller 2 comprises a metallic core 2*a* made of such metals as stainless steel, and a resilient member 2*b* coating the metallic core 2*a*. The resilient member 2*b* is made of solid or formed heat-resistant silicon rubber. The external diameter of the fixing roller 2 is 30 mm, and it is set larger than the heating roller 1 so that the press roller 4 and the fixing roller 2 come in contact at a predetermined width when pressed by the pressure of the press roller 4. The thickness of the resilient member 2*b* is 3–8 mm and the hardness is 15–50° (Asker hardness: hardness measured by JIS (Japan Industrial Standard) A is 6–25°). This configuration makes the heat capacity of the heating roller 1 smaller than that of the fixing roller 2 so as to heat the heating roller 1 rapidly, thereby shortening the warm-up time.

The belt 3 bridging the heating roller 1 and the fixing roller 2 is heated at a position W1 where it comes in contact with the heating roller 1 heated by the induction heating means 6. As the rollers 1 and 2 rotate, the inner surface of the belt 3 is heated continuously, and in this manner, the entire belt is heated.

Figure 3:
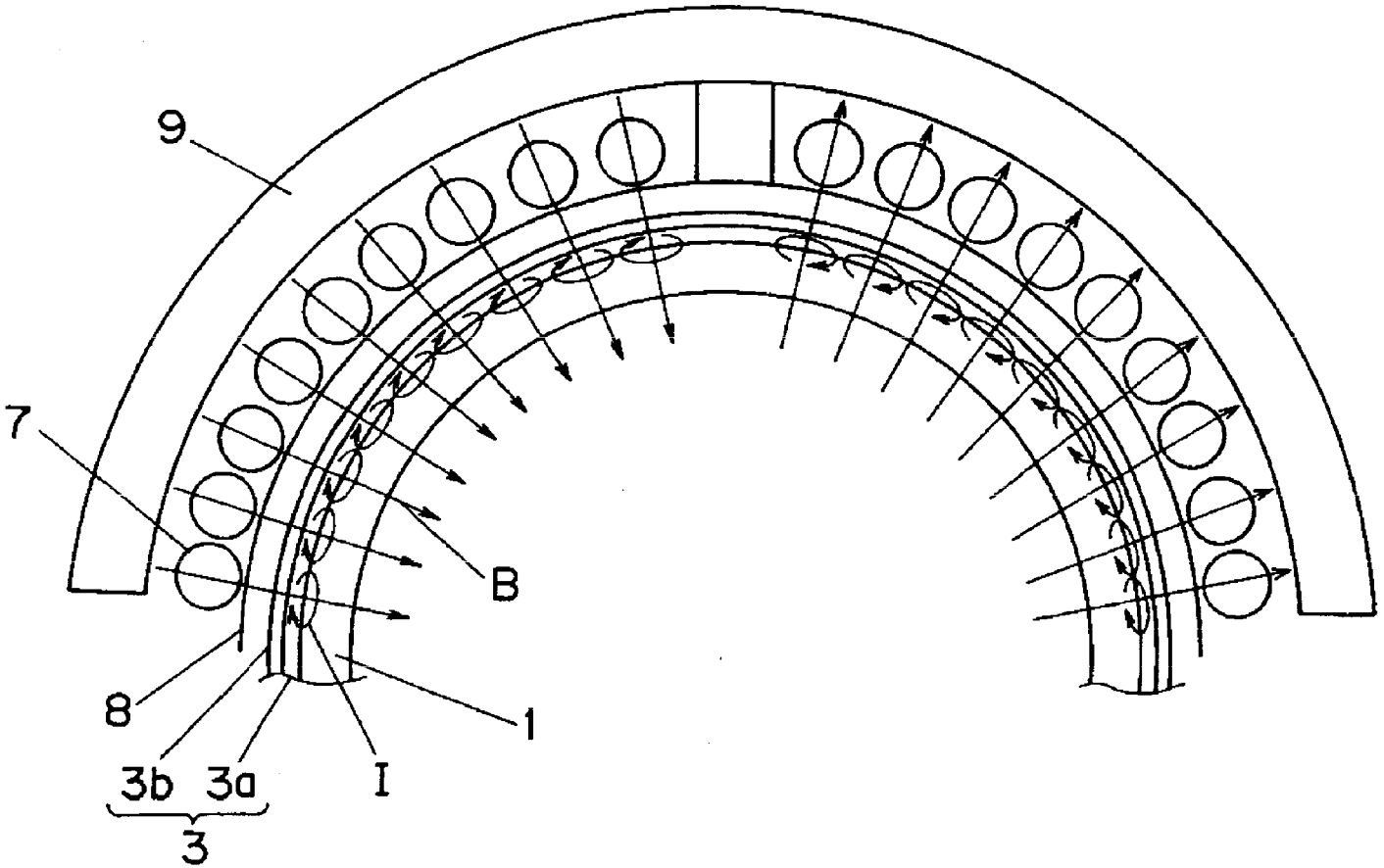
FIG. 3 is a schematic view showing the alternating magnetic field and a generation of eddy current in the fixing device of the present invention.

As FIG. 3 shows, the belt 3 is a composite layer belt which comprises a heating layer 3*a* made of magnetic metal such as iron, cobalt or nickel, or alloys of such metals as a base material, and a releasing layer 3*b* made of a resilient member such as silicon rubber and fluorocarbon rubber.

The composite layer helps to stabilize the temperature of the belt 3 and improves reliability even when a foreign object gets in between the belt 3 and the heating roller 1 and makes a gap. This is because heat from the heating layer 3*a* generated by the electromagnetic induction heats up the belt 3.

The thickness of the heating layer 3*a* is preferably 20–50 $\mu$m, and ideally about 30 $\mu$m. If the heating layer 3*a* is thicker than 50 $\mu$m, distortion stress generated during the rotation of the belt becomes large. Consequently, shear force causes cracks and in some cases lowers the mechanical strength significantly. When the heating layer 3*a* is thinner than 20 $\mu$m, thrust load generated by meandering of the belt during rotation is applied on the ends of the belt, causing cracks or fissures to develop in the composite layer belt.

The preferable thickness of the releasing layer 3*b* is between 100 and 300 $\mu$m, and ideally around 200 $\mu$m. When the thickness is within this range, the toner image T formed on the recording medium 11 can be sufficiently enclosed by the surface layer of the belt 3, thus the toner image T can be heated and melted evenly.

When the releasing layer 3*b* is thinner than 100 $\mu$m, the thermal capacity of the belt 3 becomes small. As a consequence, the temperature on the surface of the belt drops significantly during the fixing process of the toner so that sufficient fixing can not be maintained. On the other hand, if the releasing layer 3*b* is thicker than 300 μm, the heat capacity of the belt 3 becomes larger, extending the warm-up time. Furthermore, since the temperature of the surface of the belt does not drop quickly during the toner fixing process, solidification of the melted toner near the exit of the fixing section is hindered. As a result, so-called hot offset is triggered, lowering the releasing ability of the belt and allowing the toner to stick to the belt.

The inner surface of the heating layer 3*a* may be coated with resin in order to prevent oxidization of the metal and improve contact conditions with the heating roller 1.

As the base material of the belt 3, the heating layer 3*a* made of the above metals can be replaced with a heat resistant resin layer made of such resins as fluorocarbon resins, polyimide resin, polyamide resin, polyamideimide resin, PEEK, PES, and PPS.

When the base material is made of a resin layer with a high heat resistance, the belt 3 can easily fit on the heating roller according to its curvature, and the heat from the heating roller 1 can be transferred to the belt 3 effectively.

In this case, the resin layer is preferably 20–150 μm, and ideally around 75 μm in thickness. When the resin layer is thinner than 20 μm, sufficient mechanical strength against meandering during the rotation of the belt can not be obtained. On the other hand, when the resin layer is thicker than 150 μm, the heat is not effectively transferred from the heating roller 1 to the releasing layer 3*b* of the belt 3 since the heat conductivity of the resin becomes small. As a result, the fixing condition deteriorates.

The press roller 4 comprises a metal tube core 4*a* made of a metal with high heat conductivity such as copper and aluminum, and, on the surface of the core 4*a*, a resilient member 4*b* having high heat resistance and toner releasing ability. The metallic core 4*a* may be made of stainless steel in the place of the foregoing metals.

The press roller 4 presses the fixing roller 2 via the belt 3 and forms the fixing nip region N. However, in this embodiment, since the press roller 4 is harder than the fixing roller 2, the press roller 4 presses into the fixing roller 2 (and the belt 3). Due to this, the medium 11 follows the outer periphery of the press roller 4, improving the releasing ability of the medium 11 from the belt 3. The external diameter of the press roller 4 is approximately 30 mm, almost the same as that of the fixing roller 2. However, the thickness of resilient member 4*b* is about 2–5 mm, thinner than the fixing roller 2, and surface hardness is 20–60° (Asker hardness: hardness measured by JISA is 6–25°), harder than the fixing roller 2 as mentioned previously.

Figure 2B:
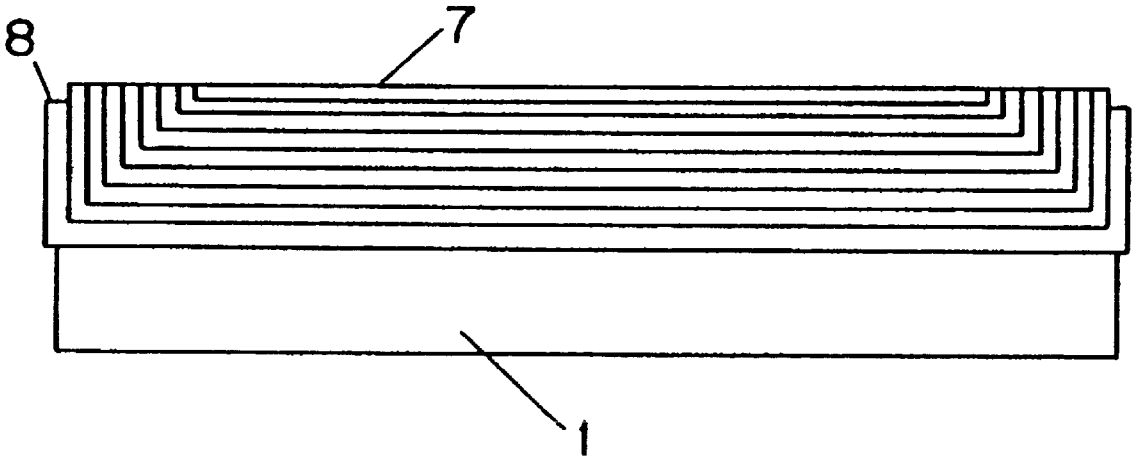
FIG. 2B is a side view showing a disposition of a coil, an induction heating means, on a coil guide plate of the fixing device of the present invention.
Figure 2A:
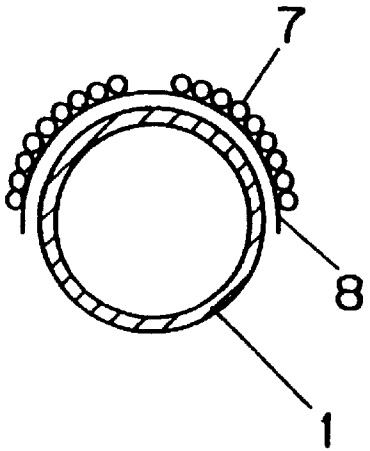
FIG. 2A is a cross sectional view showing a disposition of a coil, an induction heating means, on a coil guide plate of the fixing device of the present invention.

As shown in FIG. 2A, the induction heating means 6, which heats the heating roller 1 by electromagnetic induction, comprises a coil 7, a magnetization means, and a coil guiding plate 8 on which the magnetizing coil 7 is wound. The coil guiding plate 8 is half-cylindrical, and is disposed in the vicinity of the outer periphery of the heating roller 1. As FIG. 2B shows, the coil 7 is manufactured by alternately winding a long wire around the coil guiding plate 8, in a direction of the axis of the heating roller 1. The length of the coil is the same as the area where the belt 3 and the heating roller 1 come in contact.

This construction allows the heating roller 1 to have the largest possible area to be heated by the electromagnetic induction of the induction heating means 6. Furthermore, the contacting time between the heated surface of the heating roller 1 and belt 3 becomes as large as possible. Thus, the heat conduction efficiency to the belt 3 is increased.

The coil 7 is connected to a driving power source with a variable frequency oscillator.

Adjacent to the coil 7 is a half-cylindrical coil core 9 made of a ferromagnetic material such as ferrite, fixed on a coil core supporting member 10. In this embodiment, the coil core 9 has a relative permeability of 2500.

The coil 7 is supplied with a high-frequency alternating current of 10 kHz –1 MHz, preferably 20 kHz–800 kHz from the driving power source, thereby the coil 7 generates an alternating field. At and around the contacting position W1 of the heating roller 1 and the heat resistant belt 3, the alternating field affects the heating roller 1 and the heating layer 3*a* of the belt 3, causing an eddy current I to flow in the heating roller 1 and the heating layer 3*a* in the direction B shown in FIG. 3, a direction which prevents the alternating field from changing.

The eddy current I generates Joule heat according to the resistance of the heating roller 1 and the heating layer 3*a*, and, via the electromagnetic induction, heats up mainly at and around their contacting portion of the heating roller 1 and the belt 3 having the heating layer 3*a*.

The temperature of the inner surface of the belt 3 heated in the foregoing manner is measured in the vicinity of the entrance of the fixing nip region N by a temperature sensor 5 made with highly heat-responsive, temperature sensitive elements such as a thermistor disposed in contact with the inner surface of the belt 3.

With this construction, since the temperature sensor 5 does not damage the outer surface of the belt 3, a stable fixing capacity can be maintained and the temperature of the belt 3 just before entering in the fixing nip region N can be detected. Based on the output signals providing the temperature information, the power input into the induction heating means 6 can be controlled, thereby securely maintaining the temperature of the belt 3 at, for example, 180° C.

According to this embodiment, since the fixing nip region N is formed with the belt 3 which is heated by the heating roller 1 heated by the induction heating means 6, and the press roller 4, differences in temperatures between the outer and inner surfaces of the belt 3 are restricted when the toner image T formed on the medium 11 in the image forming section (not illustrated) enters the fixing nip region N. Therefore, so called overshoot, in which the temperature on the surface of the belt becomes excessively high compared with the set temperature, can be prevented. Thus, temperature of the belt 3, a toner heating medium, can be controlled in a stable manner.

Figure 4:
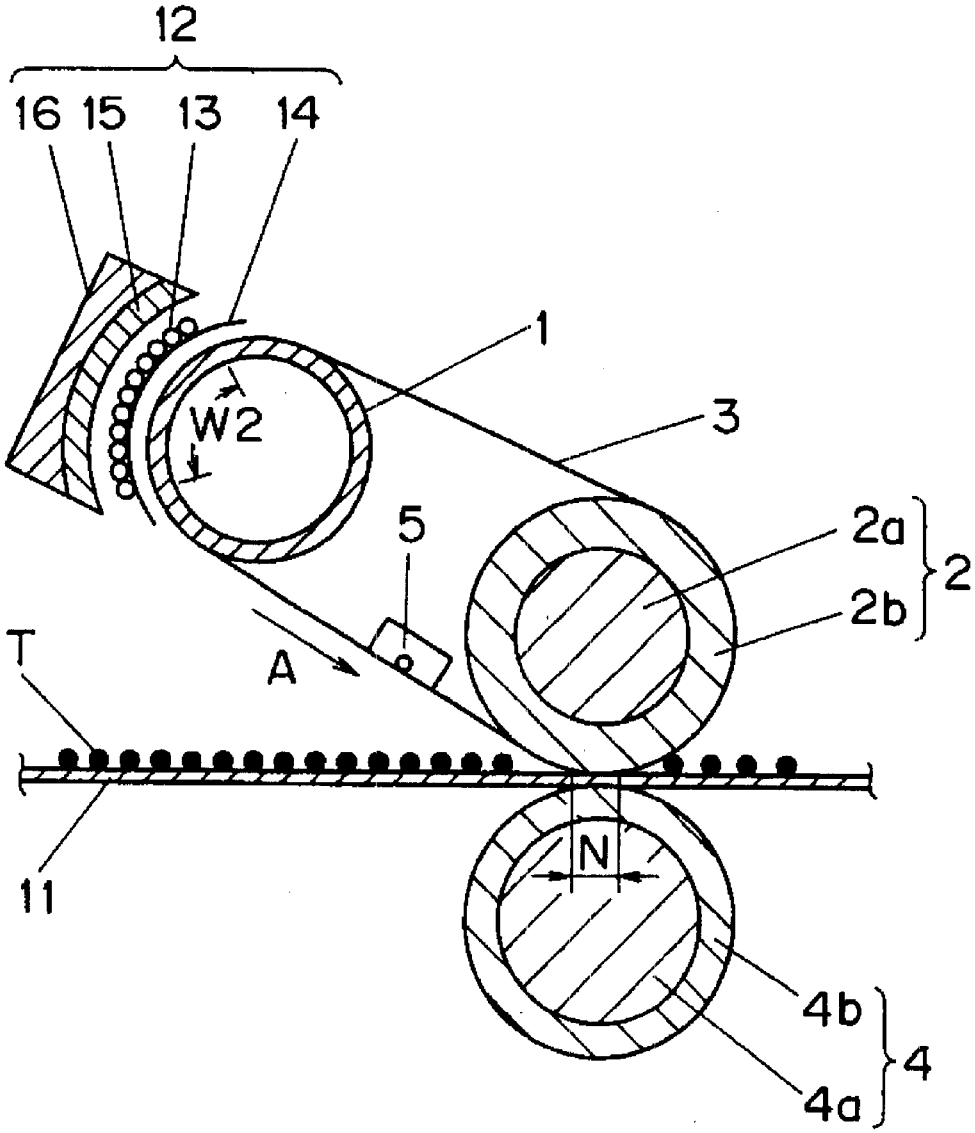
FIG. 4 shows a fixing device of another preferred embodiment of the present invention.
Figure 5:
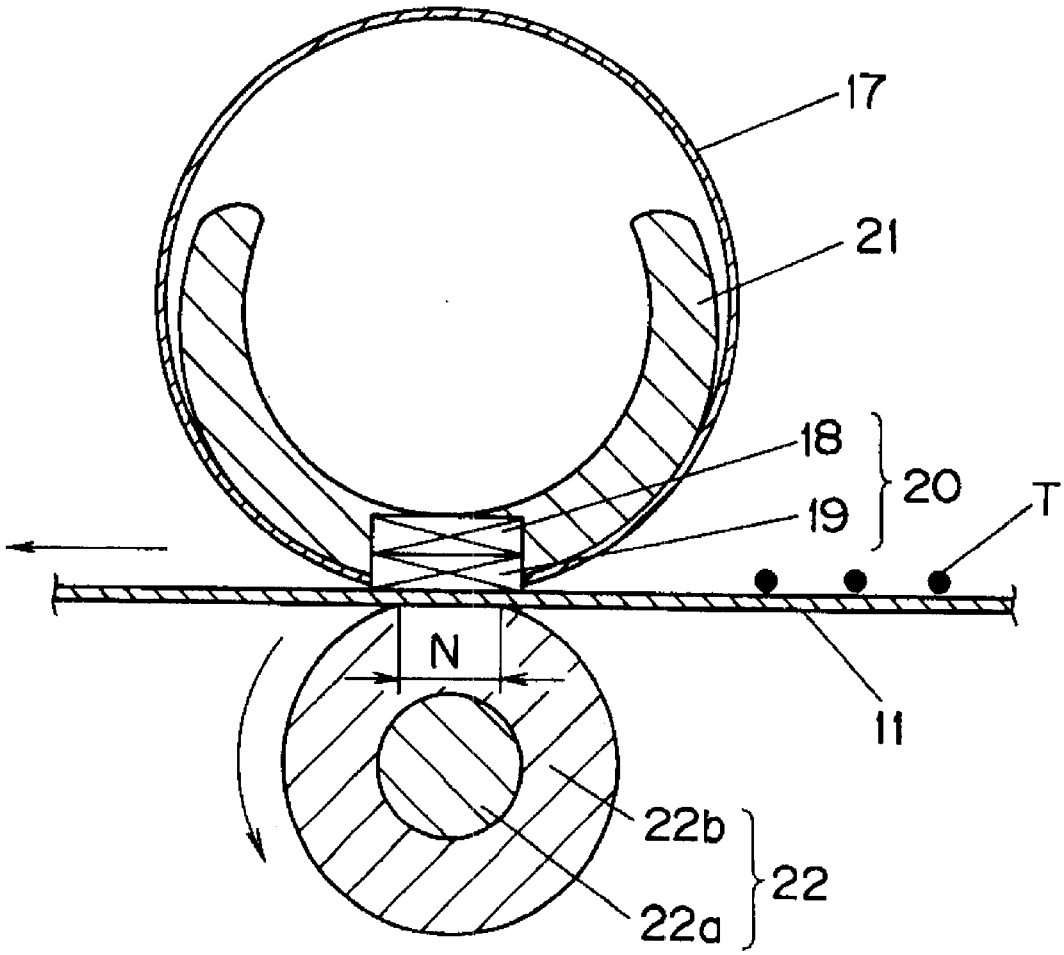
FIG. 5 Prior Art
FIG. 5 is a schematic view showing a conventional electromagnetic induction heating type fixing device.

Therefore, in the fixing process, the belt 3 whose temperature is a tightly controlled constant comes in contact with the toner image T, securing a high fixing quality. The fixing device of a second embodiment is described below. As FIG. 4 shows, in the second embodiment of the fixing device, an induction heating means 12 comprises a coil 13, a coil guiding plate 14 on which the coil 13 is wound; and a coil core 15 fixed by a coil core supporting member 16, which is disposed adjacent to the coil 13.

In this device, the heating area W2 is approximately half of the contact area of the half-cylindrical induction heating means since the induction heating means 12 is a quarter-cylindrical. With this configuration, the induction heating means 12 can be made smaller, thus the fixing device itself can be reduced in size, thereby reducing the cost of components.

According to the present invention, the fixing nip region comprises a toner heating medium which is heated by the heating roller heated by the induction heating means, and a press roller. Due to this construction, temperatures of the outer and inner surfaces of the toner heating medium are kept almost the same when entering the fixing nip region. Therefore, temperatures of the toner heating medium can be controlled in a stable manner.

The effect of the present invention can be summarized as follows.

When magnetic metals are used as the base material of the toner heating medium belt, differences in temperatures in the toner heating medium belt can be restricted even when there is a gap between the toner heating medium belt and the heating roller, since the toner heating medium belt itself heats up by the electromagnetic induction. Thus a high fixing reliability can be obtained.

When the base material of the toner heating medium belt is composed of a heat resistant resin, the toner heating medium belt can be flexibly fixed onto the heating roller according to the curvature thereof. This provides effective heat transfer from the heating roller to the toner heating medium belt.

By covering the base material of the toner heating medium belt with a resilient releasing layer of 100–300 $\mu$m in thickness, the surface layer of the toner heating medium belt can sufficiently enclose the toner image formed on the recording medium. Thus, the toner image can be evenly heated and melted.

If the induction heating means is disposed along the external periphery of the heating roller over the same length as the contacting area of the heating roller and the toner heating medium belt, the area of the heating roller to be heated by the electromagnetic induction by the induction heating means can be maximized. Furthermore, the surface of the hot heating roller and the toner heating medium belt can stay in contact for the longest possible period. Thus, the heat conduction becomes further efficient.

When the induction heating means is disposed around the external periphery of the heating roller over a length that is shorter than the contacting arc of the heating roller and the toner heating medium belt, the induction heating means can be made smaller, thereby reducing the size of the fixing device and lowering the cost of the components.

When the external diameter of the heating roller is smaller than the fixing roller, the heat capacity of the heating roller becomes smaller than that of the fixing roller, thus, the heating roller can be heated rapidly, shortening the warm-up time.

If the temperature sensor which detects the temperatures of the toner heating medium belt is disposed on the inner surface of the toner heating medium belt near the entrance of the fixing nip region such that the sensor is in contact with the toner heating medium belt, the sensor does not damage the outer surface of the toner heating medium belt, and a stable fixing ability can be maintained. Since the sensor can detect the temperature of the toner heating medium belt just before entering the fixing nip region, the temperature of the toner heating medium belt can be steadily maintained.

What is claimed is:

1. A fixing device comprising:

a heating roller made of magnetic metal to be heated by electromagnetic induction heating;

a fixing roller disposed parallel to said heating roller;

an endless toner heating medium belt arranged around said heating roller and said fixing roller so as to bridge across said heating roller and said fixing roller, said toner heating medium belt having a base material comprising magnetic metal, and said toner heating medium belt being adapted to be heated by said heating roller and rotated by said heating roller and said fixing roller; and a press roller pressed against said fixing roller via said toner heating medium belt at a contact position, and arranged so as to rotate such that an outer surface of said press roller moves in the same direction as said toner heating medium belt at the contact position so as to form a fixing nip region.

2. The fixing device of claim 1, further comprising an electromagnetic induction heating device arranged at an external periphery of said heating roller along a contact arc between said heating roller and said toner heating medium belt.

3. The fixing device of claim 1, further comprising an electromagnetic induction heating device arranged at an external periphery of said heating roller along an induction heating arc shorter than a contact arc between said heating roller and said toner heating medium belt.

4. The fixing device of claim 1, wherein an external diameter of said heating roller is smaller than an external diameter of said fixing roller.

5. The fixing device of claim 1, further comprising a temperature sensor disposed at said fixing nip region, said temperature sensor contacting an inner surface of said toner heating medium belt.

6. A fixing device comprising:

a heating roller made of magnetic metal to be heated by electromagnetic induction heating;

a fixing roller disposed parallel to said heating roller;

an endless toner heating medium belt arranged around said heating roller and said fixing roller so as to bridge across said heating roller and said fixing roller, said toner heating medium belt being adapted to be heated by said heating roller and rotated by said heating roller and said fixing roller; and a press roller pressed against said fixing roller via said toner heating medium belt at a contact position, and arranged so as to rotate such that an outer surface of said press roller moves in the same direction as said toner heating medium belt at the contact position so as to form a fixing nip region;

wherein said toner heating medium belt has a base material, a surface of said base material being coated with a resilient layer having a thickness of 100–300 $\mu$m.

7. The fixing device of claim 6, wherein said resilient layer has a releasing ability.

8. The fixing device of claim 7, further comprising an electromagnetic induction heating device arranged at an external periphery of said heating roller along a contact arc between said heating roller and said toner heating medium belt.

9. The fixing device of claim 7, further comprising an electromagnetic induction heating device arranged at an external periphery of said heating roller along an induction heating arc shorter than a contact arc between said heating roller and said toner heating medium belt.

10. The fixing device of claim 7, wherein an external diameter of said heating roller is smaller than an external diameter of said fixing roller.

11. The fixing device of claim 7, further comprising a temperature sensor disposed at said fixing nip region, said temperature sensor contacting an inner surface of said toner heating medium belt.

12. The fixing device of claim 6, further comprising an electromagnetic induction heating device arranged at an external periphery of said heating roller along a contact arc between said heating roller and said toner heating medium belt.

13. The fixing device of claim 6, further comprising an electromagnetic induction heating device arranged at an external periphery of said heating roller along an induction heating arc shorter than a contact arc between said heating roller and said toner heating medium belt.

14. The fixing device of claim 6, wherein an external diameter of said heating roller is smaller tan an external diameter of said fixing roller.

15. The fixing device of claim 6, further comprising a temperature sensor disposed at said fixing nip region, said temperature sensor contacting an inner surface of said toner heating medium belt.

16. The fixing device of claim 6, wherein said base material comprises a magnetic metal.

17. A fixing device comprising:

a heating roller made of magnetic metal to be heated by electromagnetic induction heating;

a fixing roller disposed parallel to said heating roller;

an endless toner heating medium belt arranged around said heating roller and said fixing roller so as to bridge across said heating roller and said fixing roller, said toner heating medium belt being adapted to be heated by said heating roller and rotated by said heating roller and said fixing roller; and a press roller pressed against said fixing roller via said toner heating medium belt at a contact position, and arranged so as to rotate such that an outer surface of said press roller moves in the same direction as said toner heating medium belt at the contact position so as to form a fixing nip region;

wherein said toner heating medium belt has a base material comprising a heat resistant resin.

18. The fixing device of claim 17, wherein a surface of said base material is coated with a resilient layer having a thickness of 100–300 $\mu$m.

19. The fixing device of claim 18, wherein said resilient layer has a releasing ability.

20. The fixing device of claim 19, further comprising an electromagnetic induction heating device arranged at an external periphery of said heating roller along a contact arc between said heating roller and said toner heating medium belt.

21. The fixing device of claim 19, further comprising an electromagnetic induction heating device arranged at an external periphery of said heating roller along an induction heating arc shorter than a contact arc between said heating roller and said toner heating medium belt.

22. The fixing device of claim 19, further comprising a temperature sensor disposed at said fixing nip region, said temperature sensor contacting an inner surface of said toner heating medium belt.

23. The fixing device of claim 19, wherein an external diameter of said heating roller is smaller than an external diameter of said fixing roller.

24. The fixing device of claim 18, further comprising an electromagnetic induction heating device arranged at an external periphery of said heating roller along a contact arc between said heating roller and said toner heating medium belt.

25. The fixing device of claim 18, further comprising an electromagnetic induction heating device arranged at an external periphery of said heating roller along an induction heating arc shorter than a contact arc between said heating roller and said toner heating medium belt.

26. The fixing device of claim 18, wherein an external diameter of said heating roller is smaller than an external diameter of said fixing roller.

27. The fixing device of claim 18, further comprising a temperature sensor disposed at said fixing nip region, said temperature sensor contacting an inner surface of said toner heating medium belt.

28. The fixing device of claim 17, further comprising an electromagnetic induction heating device arranged at an external periphery of said heating roller along a contact arc between said heating roller and said toner heating medium belt.

29. The fixing device of claim 17, further comprising an electromagnetic induction heating device arranged at an external periphery of said heating roller along an induction heating arc shorter than a contact arc between said heating roller and said toner heating medium belt.

30. The fixing device of claim 17, wherein an external diameter of said heating roller is smaller than an external diameter of said fixing roller.

31. The fixing device of claim 17, further comprising a temperature sensor disposed at said fixing nip region, said temperature sensor contacting an inner surface of said toner heating medium belt.

32. A fixing device comprising:

a heating roller made of magnetic metal to be heated by electromagnetic induction heating;

a fixing roller disposed parallel to said heating roller;

an endless toner heating medium belt arranged around said heating roller and said fixing roller so as to bridge across said heating roller and said fixing roller, said toner heating medium belt including a material adapted to be heated by electromagnetic induction heating, said toner heating medium belt having a base material, a surface of said base material being coated with a resilient layer having a thickness of 100–300 $\mu$m, and said toner heating medium belt being adapted to be heated by said heating roller and rotated by said heating roller and said fixing roller; and a press roller pressed against said fixing roller via said toner heating medium belt at a contact position, and arranged so as to rotate such that an outer surface of said press roller moves in the same direction as said toner heating medium belt at the contact position so as to form a fixing nip region.

33. The fixing device of claim 32, further comprising an electromagnetic induction heating device arranged at an external periphery of said heating roller along a contact arc between said heating roller and said toner heating medium belt.

34. The fixing device of claim 32, further comprising an electromagnetic induction heating device arranged at an external periphery of said heating roller along an induction heating arc shorter than a contact arc between said heating roller and said toner heating medium belt.

35. The fixing device of claim 32, wherein an external diameter of said heating roller is smaller than an external diameter of said fixing roller.

36. The fixing device of claim 32, further comprising a temperature sensor disposed at said fixing nip region, said temperature sensor contacting an inner surface of said toner heating medium belt.

* * * * *